US011103908B2

(12) United States Patent
Tokunaga

(10) Patent No.: US 11,103,908 B2
(45) Date of Patent: Aug. 31, 2021

(54) COILED MATERIAL PASSING DEVICE AND COILED MATERIAL PASSING METHOD

(71) Applicant: KOMATSU INDUSTRIES CORPORATION, Kanazawa (JP)

(72) Inventor: Hidekazu Tokunaga, Komatsu (JP)

(73) Assignee: KOMATSU INDUSTRIES CORPORATION, Ishikawa (JP)

( * ) Notice: Subject to any disclaimer, the term of this patent is extended or adjusted under 35 U.S.C. 154(b) by 298 days.

(21) Appl. No.: 15/779,631

(22) PCT Filed: Dec. 26, 2016

(86) PCT No.: PCT/JP2016/088627

§ 371 (c)(1),
(2) Date: May 29, 2018

(87) PCT Pub. No.: WO2017/126295

PCT Pub. Date: Jul. 27, 2017

(65) Prior Publication Data

US 2018/0345345 A1 Dec. 6, 2018

(30) Foreign Application Priority Data

Jan. 19, 2016 (JP) ..... JP2016-008226

(51) Int. Cl.
*B21C 47/18* (2006.01)
*B21C 47/34* (2006.01)
(Continued)

(52) U.S. Cl.
CPC ..... *B21C 47/18* (2013.01); *B21C 47/04* (2013.01); *B21C 47/34* (2013.01); *B21C 47/3433* (2013.01); *B21D 3/05* (2013.01)

(58) Field of Classification Search
CPC ..... B21C 47/16; B21C 47/18; B21C 47/3433; B21C 47/24; B21C 47/34; B21D 3/02; B21D 1/02
See application file for complete search history.

(56) References Cited

U.S. PATENT DOCUMENTS 3,223,344 A * 12/1965 Weymouth ..... B21C 47/34 242/564.1
3,343,762 A * 9/1967 Ungerer ..... B21C 47/18 242/78.6
(Continued)

FOREIGN PATENT DOCUMENTS

CN 1541144 A 10/2004
CN 102059555 A 5/2011
(Continued)

OTHER PUBLICATIONS

The Office Action for the corresponding Chinese application No. 20168006839.8, dated Jan. 25, 2019.
(Continued)

*Primary Examiner* — Adam J Eiseman
*Assistant Examiner* — Matthew Stephens
(74) *Attorney, Agent, or Firm* — Global IP Counselors, LLP

(57) ABSTRACT

A coiled material passing device is usable to pass a coiled material played out by an uncoiler to a leveler feeder configured to correct any winding curl of the coiled material. The coiled material passing device includes a clamper configured to clamp a starting end of the coiled material played out from the uncoiler, a moving body configured to support the clamper, the moving body being movable between the uncoiler and the leveler feeder, and a first driver configured to move the moving body.

16 Claims, 12 Drawing Sheets

(51) Int. Cl.
*B21C 47/04* (2006.01)
*B21D 3/05* (2006.01)

(56) References Cited

U.S. PATENT DOCUMENTS

| | | | | | |
|---|---|---|---|---|---|
| 4,285,475 | A * | 8/1981 | Rogers | B21C 47/006 | 242/525.7 |
| 4,730,781 | A * | 3/1988 | Richter | B21B 39/006 | 242/559.3 |
| 9,890,023 | B2 * | 2/2018 | Codd | B66D 5/02 | 242/78.6 |
| 2003/0029214 | A1 * | 2/2003 | Steudle | B21C 47/18 | 72/183 |
| 2004/0239018 | A1 | 12/2004 | Kruger et al. | | |
| 2006/0157434 | A1 * | 7/2006 | Dreisbach | B21C 47/24 | 211/151 |
| 2008/0190258 | A1 * | 8/2008 | Moser | B21C 47/3433 | 83/649 |
| 2009/0211324 | A1 * | 8/2009 | McKenney | B21C 47/22 | 72/250 |

FOREIGN PATENT DOCUMENTS

| | | | | | |
|---|---|---|---|---|---|
| CN | 104624721 | A | | 5/2015 | |
| DE | 19650582 | B4 | * | 3/2008 | B21C 47/3441 |
| DE | 102012214803 | A1 | * | 2/2014 | B65H 19/10 |
| EP | 0284918 | B1 | * | 2/1992 | B21C 47/34 |
| EP | 0249543 | B1 | * | 3/1994 | B21C 47/3433 |
| EP | 2446976 | A1 | * | 5/2012 | B21C 47/3433 |
| JP | 59-19028 | A | | 1/1984 | |
| JP | 62-156021 | A | | 7/1987 | |
| JP | 3-216442 | A | | 9/1991 | |
| JP | 9-323121 | A | | 12/1997 | |
| JP | 11-169951 | A | | 6/1999 | |
| JP | H-11169951 | A | * | 6/1999 | B21C 47/18 |

OTHER PUBLICATIONS

The International Search Report for the corresponding international application No. PCT/JP2016/088627, dated Mar. 21, 2017.

* cited by examiner

COILED MATERIAL PASSING DEVICE AND COILED MATERIAL PASSING METHOD

CROSS-REFERENCE TO RELATED APPLICATIONS

This application is a U.S. National stage application of International Application No. PCT/JP2016/088627, filed on Dec. 26, 2016. This U.S. National stage application claims priority under 35 U.S.C. § 119(a) to Japanese Patent Application No. 2016-008226, filed in Japan on Jan. 19, 2016, the entire contents of which are hereby incorporated herein by reference.

BACKGROUND

Field of the Invention

The present invention relates to a coiled material passing device and a coiled material passing method.

Description of the Related Art

A coiled material such as a steel sheet wound in a coil is used as a material in pressing machines and the like. A configuration comprising an uncoiler, a coiled material passing mechanism, and a leveler has been disclosed as a system for supplying such a coiled material to a pressing machine (see JP-A H11-169951, for example).

In JP-A H11-169951, after the coiled material is placed in the uncoiler, the starting end of the coiled material is passed through the leveler by the coiled material passing mechanism.

With the coiled material passing mechanism in JP-A H11-169951, a loop guide is raised to play out the coiled material, and a threading roll that also serves as an upper pinch roll is moved, thereby pressing in on the starting end of the coiled material. This movement of the threading roll causes the starting end of the coiled material to be clamped between the threading roll and the drive pinch roll. The drive pinch roll is then driven so that the starting end of the coiled material is fed into the leveler.

SUMMARY

However, the following problems are encountered with the coiled material passing mechanism in the above-mentioned JP-A H11-169951.

In order to press in the starting end of the coiled material with the threading roll, it is necessary to feed the starting end of the coiled material up to a position beyond the threading roll, but the sheet cannot pass through if the starting end of the coiled material catches on the surrounding structure.

Also, when the starting end of the coiled material is pushed down toward the drive pinch roll by the threading roll, the threading roll moves while scribing an arc from the uncoiler side to the leveler side, so if only a small amount of the coiled material is played out from the uncoiler, there is a possibility that the starting end of the coiled material may come off from the threading roll. Conversely, if a large amount of the coiled material is played out, the starting end of the coiled material may be bent by the threading roll and the upper stop guide on the leveler feeder side. For this reason, the operator has to make fine adjustments to the amount of playout in order to stably pass the coiled material played out from the uncoiler to the leveler.

In view of the above problems encountered in the past, it is an object of the present invention to provide a coiled material passing device and a coiled material passing method with which the passing of a coiled material can be carried out stably.

The coiled material passing device pertaining to the first aspect is a coiled material passing device for passing a coiled material played out by an uncoiler to a leveler feeder that corrects any winding curl of the coiled material, said device comprising a clamper, a moving body, and a first driver. The clamper clamps the starting end of the coiled material played out from the uncoiler. The moving body supports the clamper and is able to move between the uncoiler and the leveler feeder. The first driver moves the moving body.

Consequently, the starting end of the coiled material can be passed through the leveler feeder by moving the moving body to the leveler feeder in a state in which the starting end of the coiled material is clamped by the clamper.

That is, since the clamper can be moved, the starting end of the coiled material can be clamped near the uncoiler, for example. Therefore, there are substantially no members that will interfere with the starting end of the coiled material, which reduces the possibility that the starting end of the coiled material will catch on the device components.

Also, after the starting end of the coiled material is clamped near the coiled material, the clamper moves in a clamped state and the starting end of the coiled material moves to the leveler feeder, so the coiled material can be easily fed into the leveler feeder without the operator having to make fine adjustments to the amount of playout of the coiled material as in the past.

As mentioned above, it is easy to stably pass the starting end of the coiled material played out from the uncoiler to the leveler feeder.

The coiled material passing device pertaining to the second aspect is the coiled material passing device pertaining to the first aspect, wherein the clamper has a first roll, a second roll, and a second driver. The first roll is capable of moving between a clamping position at which the starting end of the coiled material played out from the uncoiler is clamped and a standby position above the center of the coiled material attached to the uncoiler. The second roll is disposed below the first roll and clamps the coiled material played out from the uncoiler, along with the first roll disposed at the clamping position. The second driver moves the first roll between the clamping position and the standby position.

Consequently, the first roll can be moved downward and the starting end of the coiled material can be clamped between the first roll and the second roll.

Also, in the standby position, since the first roll is disposed above the center of the coiled material, when the coiled material is rotated in the reverse direction, the starting end of the coiled material that has passed the first roll will be located below the first roll. Therefore, the starting end of the coiled material can be clamped between the first roll and the second roll by moving the first roll downward.

Also, since the starting end of the coiled material is positioned below the first roll merely by reverse rotation, there is no need to feed the coiled material forward before the starting end of the coiled material is clamped, and the coiled material can be clamped stably.

The coiled material passing device pertaining to the third aspect is the coiled material passing device pertaining to the second aspect, wherein the standby position is a position near the outer periphery of the coiled material attached to the uncoiler in a state in which the moving body has been moved to the uncoiler side by the first driver.

Since the first roll is thus put on standby near the outer periphery of the coiled material, even if the coiled material is very stiff, the starting end of the coiled material that has passed the first roll is positioned below the first roll by reversely rotating the coiled material and protrudes on the downstream side. Therefore, the starting end of the coiled material can be clamped between the first roll and the second roll by moving the first roll downward.

The coiled material passing device pertaining to the fourth aspect is the coiled material passing device pertaining to the first aspect, wherein the moving body has a support. The support is disposed more on the uncoiler side than the second roll, and supports the played out coiled material from below. The support hits the outer periphery of the coiled material in a state of being attached to the uncoiler by the movement of the moving body to the uncoiler side with the first driver.

The support thus hits the outer periphery of the coiled material and supports the coiled material from below, which allows the coiled material unwound from its coiled state to be stably supplied between the first roll and the second roll.

This eliminates the need for a loop guide under the coiled material.

The cold material passing device pertaining to the fifth aspect is the coiled material passing device pertaining to the third aspect, wherein the moving body has a support. The support is disposed more on the uncoiler side than the second roll, and supports the played out coiled material from below. The support hits the outer periphery of the coiled material in a state of being attached to the uncoiler by the movement of the moving body to the uncoiler side with the first driver. The support is formed in a curved shape. The length along the curve from the second roll to the contact position where the support hits the coil material in a state of being attached to the uncoiler is shorter than the length around the outer periphery of the coiled material from the contact position to the outer peripheral position closest to the standby position of the coiled material in a state of being attached to the uncoiler.

Consequently, the coiled material can be rotated in the reverse direction so that the length of the portion separated from the coiled state of the coiled material that has passed the first roll at the standby position is longer than the length from the contact position to the position of the second roll, so the coiled material can be clamped between the first roll and the second roll by moving the first roll downward.

The coiled material passing method pertaining to the sixth aspect is a coiled material passing method for passing a coiled material played out by an uncoiler through a leveler feeder that corrects any winding curl of the coiled material, said method comprising a reverse rotation step, a clamping step, and a movement step. The reverse rotation step involves reversing the rotation of the uncoiler until the starting end of the coiled material passes a first roll disposed near the outer periphery and above the center of the coiled material in a state of being attached to the uncoiler. The clamping step involves moving the first roll toward a second roll disposed below the first roll so that the first roll hits the starting end of the coiled material from above, and the starting end of the coiled material is clamped between the first roll and the second roll. The movement step involves moving the first roll and the second roll to the leveler feeder in a state in which the starting end of the coiled material is clamped.

Consequently, the starting end of the coiled material can be clamped near the uncoiler. Therefore, it is less likely that the starting end of the coiled material will catch on something.

Also, after the starting end of the coiled material is clamped near the coiled material, the clamping part moves in a clamped state, and the starting end of the coiled material moves to the leveler feeder, so the coiled material can be easily fed to the leveler feeder without the operator having to make fine adjustments to the amount of playout of the coiled material as in the past.

As discussed above, it is easy to stably pass the starting end of the coiled material played out from the uncoiler to the leveler feeder.

Also, the starting end of the coiled material that has passed the first roll is positioned below the first roll by rotating the coiled material in the reverse direction, so the starting end of the coiled material can be clamped between the first roll and the second roll by moving the first roll downward.

Also, since the first roll is disposed above the center of the coiled material, the starting end of the coiled material that has passed the first roll is positioned lower than the first roll when the coiled material is rotated in reverse. Therefore, the starting end of the coiled material can be clamped between the first roll and the second roll by moving the first roll downward.

Also, since the starting end of the coiled material is positioned lower than the first roll by reverse rotation, there is no need to feed the coiled material forward before it is clamped, and the coiled material can be clamped stably.

Also, since the first roll stands by near the outer periphery of the coiled material, even when the coiled material is very stiff, the coiled material is rotated reversely, and the starting end of the coiled material that has passed the first roll is positioned lower than first roll and protrudes to the downstream side. Therefore, the starting end of the coiled material can be clamped between the first roll and the second roll by moving the first roll downward.

The present invention provides a coiled material passing device and a coiled material passing method with which it is easy to perform stable passing of the material.

DETAILED DESCRIPTION OF EMBODIMENT(S)

A coil line system comprising the coiled material passing device in an embodiment of the present invention will now be described through reference to the drawings.

1. Configuration 1-1. Overview of Coil Line System 1

Figure 1:
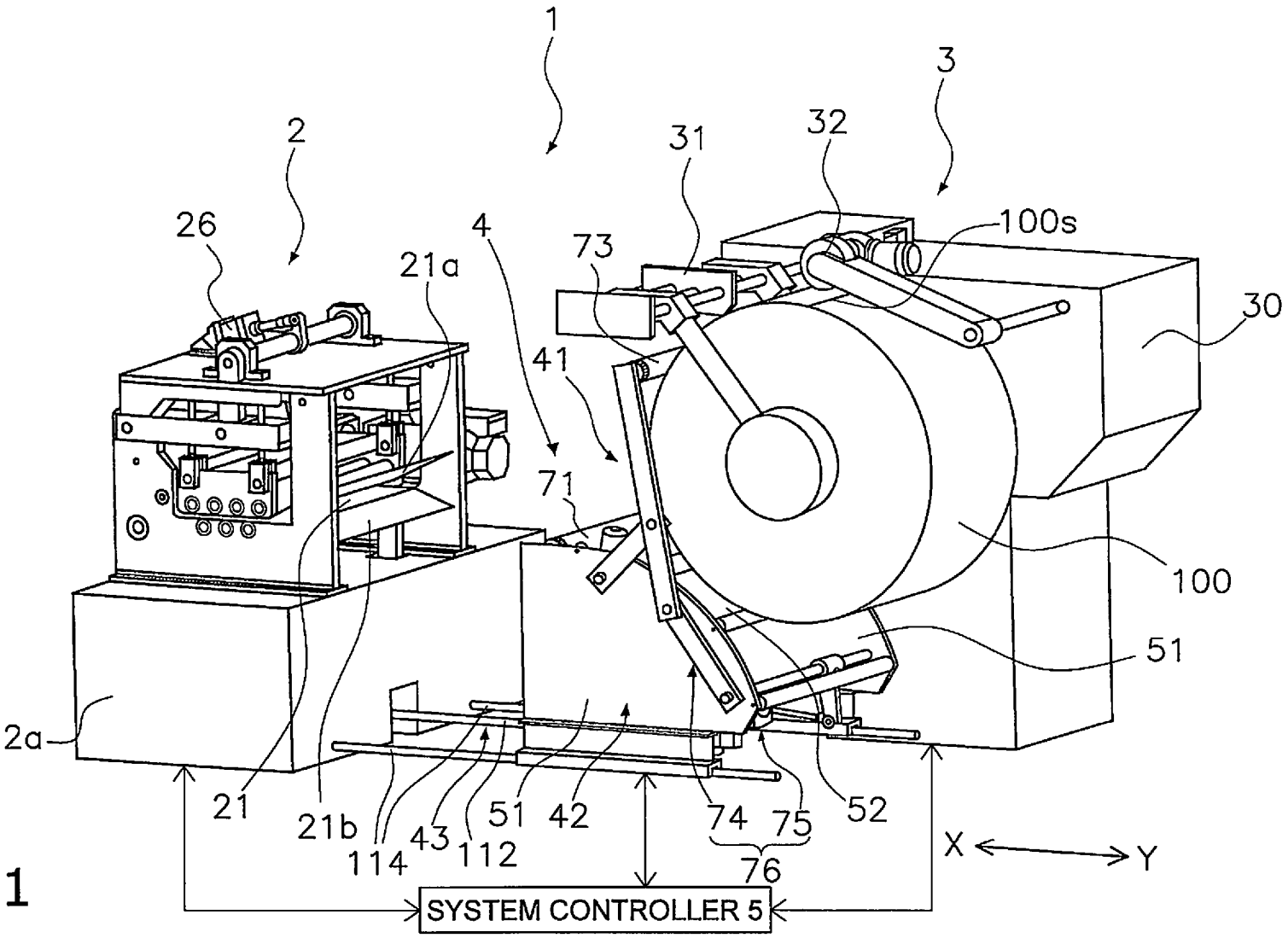
FIG. 1 is an oblique view of the configuration of the coil line system of the present invention.

FIG. 1 is a simplified diagram showing the configuration of a coil line system 1 in this embodiment. As shown in FIG. 1, the coil line system 1 in this embodiment comprises a leveler feeder 2, an uncoiler 3, a coiled material passing device 4, and a system controller 5.

The leveler feeder 2 corrects winding curl and the like in the coiled material 100 supplied from a receiver port 21. The coiled material 100 is supplied from the uncoiler 3 to the receiver port 21 of the leveler feeder 2.

The uncoiler 3 unwinds the coiled material 100 (a steel sheet, etc., that is wound in a coil) while feeding it to the leveler feeder 2.

The coiled material passing device 4 is provided more or less between the leveler feeder 2 and the uncoiler 3. The coiled material passing device 4 automatically guides the starting end 100*s* of the coiled material 100 played out from the uncoiler 3 to the receiver port 21 of the leveler feeder 2.

The downstream side of the coiled material 100 in the transport direction is shown as X, and the upstream side is shown as Y.

The system controller 5 transmits commands to the leveler feeder 2, the uncoiler 3, and the coiled material passing device 4 on the basis of worker input from a control panel (not shown).

1-2. Leveler Feeder 2

Figure 2:
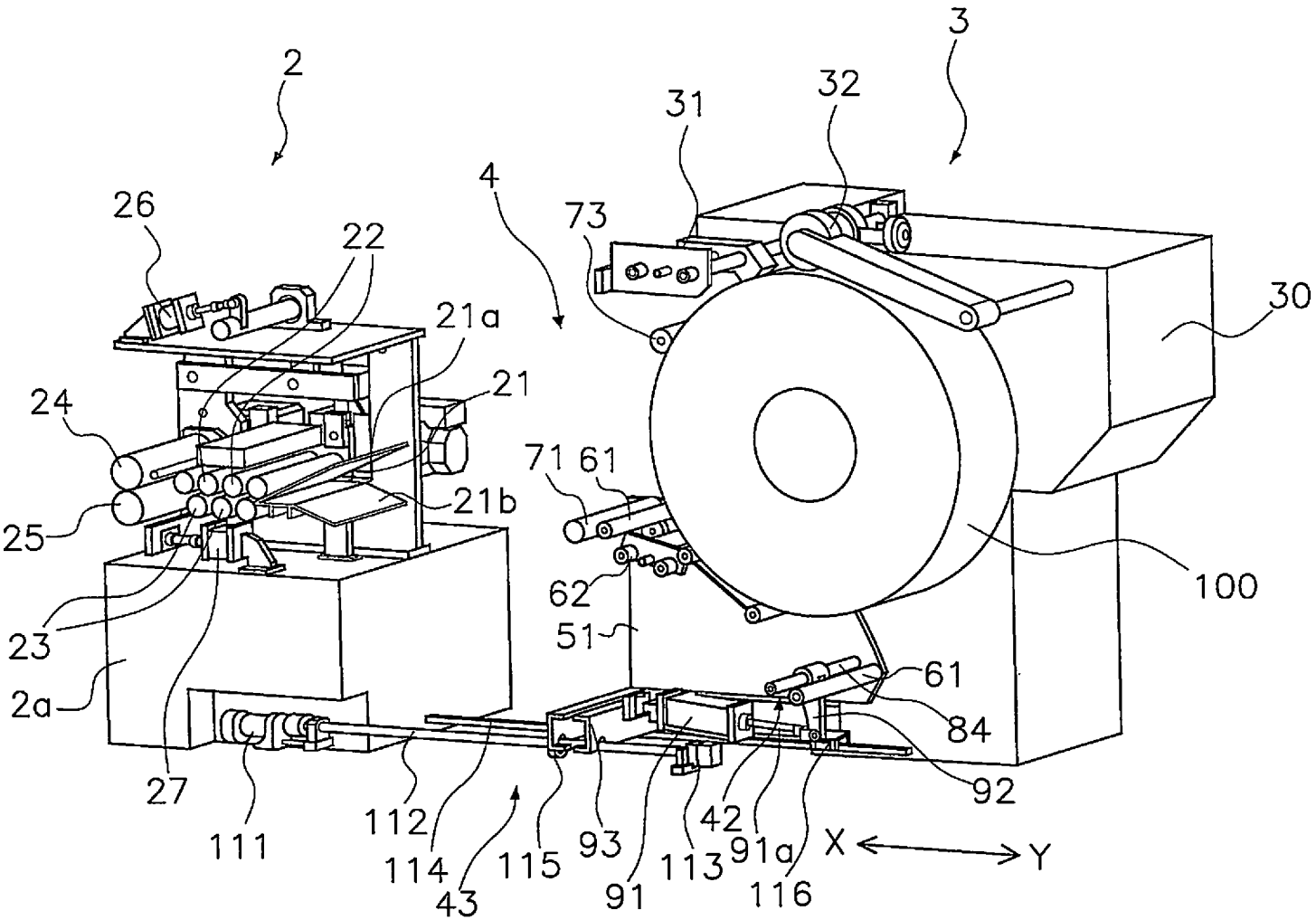
FIG. 2 is a cross section of the internal configuration of the coil line system in FIG. 1.
Figure 3:
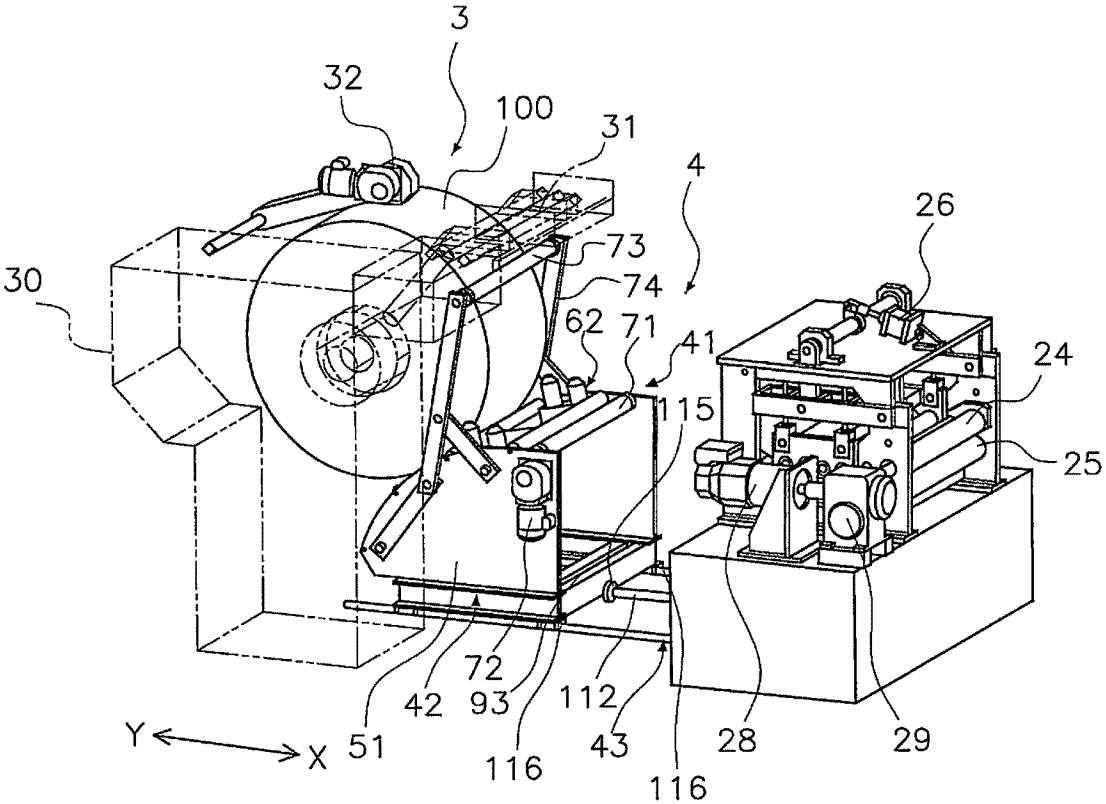
FIG. 3 is an oblique view of the coil line system in FIG. 1 as viewed from the rear.

FIG. 2 is an oblique view of the internal configuration of the coil line system in FIG. 1, and FIG. 3 is a diagram of the coil line system in FIG. 1 as viewed from the rear. In FIG. 3, a coil support 30 and a coil guide 31 of the uncoiler 3 (discussed below) are indicated by one-dot chain lines in order to make the figure easy to understand.

Figure 6:
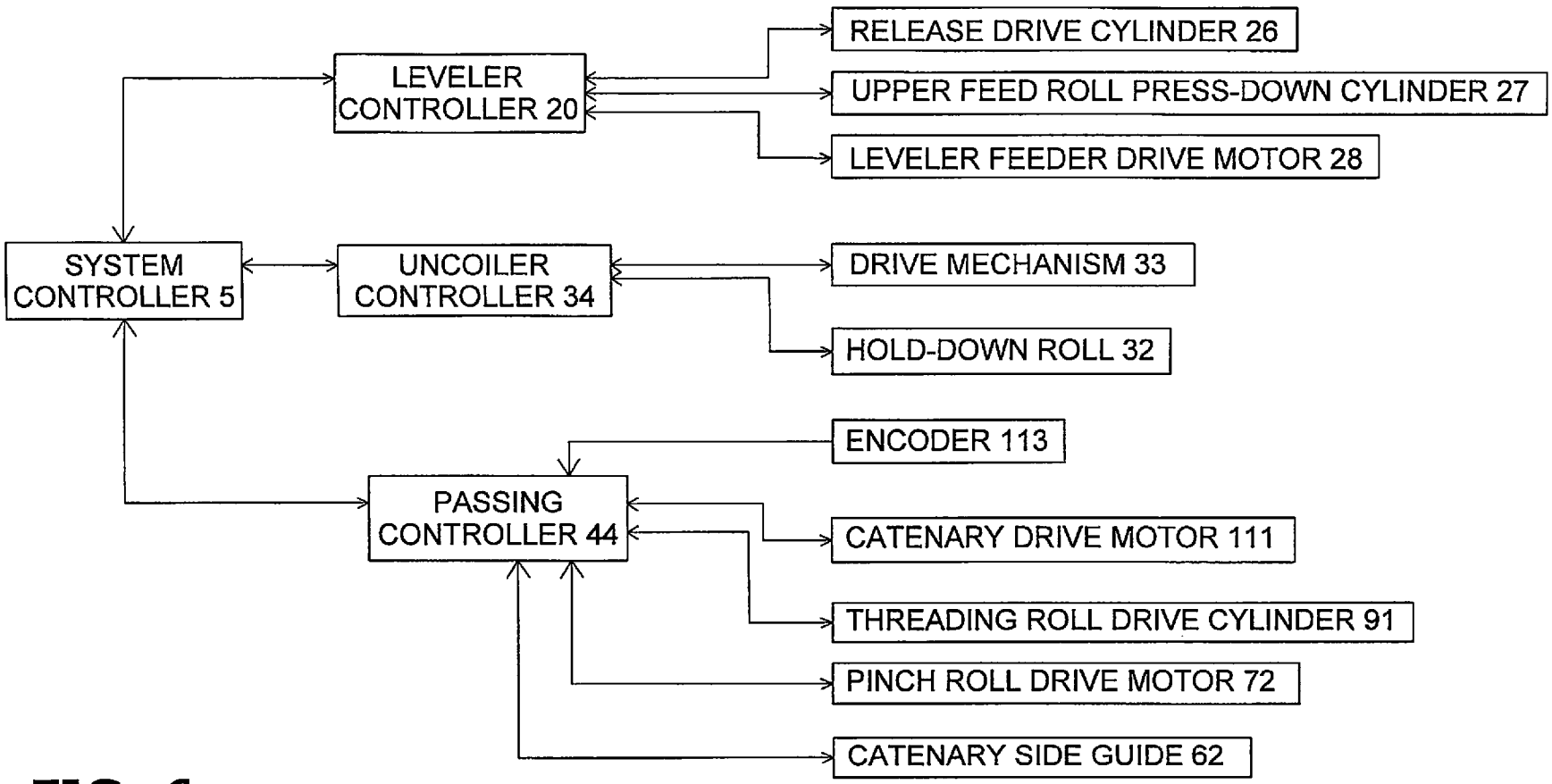
FIG. 6 is a block diagram showing the control configuration of the coil line system in FIG. 1.

As shown in FIGS. 2 and 3, the leveler feeder 2 includes the receiver port 21, a plurality of upper work rolls 22, a plurality of lower work rolls 23, an upper feed roll 24, a lower feed roll 25, a release drive cylinder 26, an upper feed roll press-down cylinder 27, a leveler feeder drive motor 28, a leveler feeder drive speed reducer 29, and a leveler controller 20 (see FIG. 6).

The receiver port 21 is formed on the uncoiler 3 side of the leveler feeder 2, and receives the coiled material 100 played out from the uncoiler 3. The receiver port 21 is formed by an upper guide plate 21*a* and a lower guide plate 21*b* that are disposed one above the other. The upper guide plate 21*a* and the lower guide plate 21*b* are formed with the uncoiler 3 side inclined so that the vertical spacing between them increases moving toward the uncoiler 3.

Any distortion or winding curl in the coiled material 100 supplied from the receiver port 21 is corrected by the upper work rolls 22 and the lower work rolls 23. The coiled material 100 is then played out from a delivery port via the upper feed roll 24 and the lower feed roll 25, and is supplied to a press die (not shown). The release drive cylinder 26 is linked to the upper work rolls 22, and separates the upper work rolls 22 from the lower work rolls 23. The upper feed roll press-down cylinder 27 adjusts the pressing of the upper feed roll 24 against the lower feed roll 25. The rotation of the leveler feeder drive motor 28 is decelerated by the leveler feeder drive speed reducer 29, and then rotates the upper feed roll 24 and the lower feed roll 25 to convey the coiled material 100.

The leveler controller 20 controls the release drive cylinder 26, the upper feed roll press-down cylinder 27, and the leveler feeder drive motor 28, as shown in FIG. 6 (discussed below).

1-3. Uncoiler 3

The uncoiler 3 unwinds and plays out the required amount of the coiled material 100, which is wound in a coil shape. As shown in FIG. 1, the uncoiler 3 has the coil support 30, the coil guide 31, a hold-down roll 32, a drive mechanism 33 (see FIG. 6), and an uncoiler controller 34 (see FIG. 6).

The coil support 30 rotatably supports the Coiled material 100 that is wound in a coil. The coil guide 31 guides the playout of the coiled material 100. The hold-down roll 32 holds the coiled material 100 down.

The drive mechanism 33 shown in FIG. 6 drives the coiled material 100 supported by the coil support 30 in forward rotation (the direction in which the coiled material 100 is played out) or in reverse rotation.

The uncoiler controller 34 controls the drive mechanism 33, the hold-down roll 32, and the like on the basis of commands from the system controller 5.

1-4. Coiled Material Passing Device 4

The coiled material passing device 4 passes the starting end 100*s* of the coiled material 100 played out from the uncoiler 3 into the receiver port 21 of the leveler feeder 2. As shown in FIG. 1, the coiled material passing device 4 has a clamper 41, a catenary component 42, a driver 43, and a passing controller 44 (see FIG. 6). The clamper 41 clamps the starting end 100*s* of the coiled material 100. The catenary component 42 supports the clamper 41 and is able to move between the uncoiler 3 and the leveler feeder 2. The driver 43 moves the catenary component 42 between the uncoiler 3 and the leveler feeder 2.

1-4-1. Catenary Component 42

Figure 4:
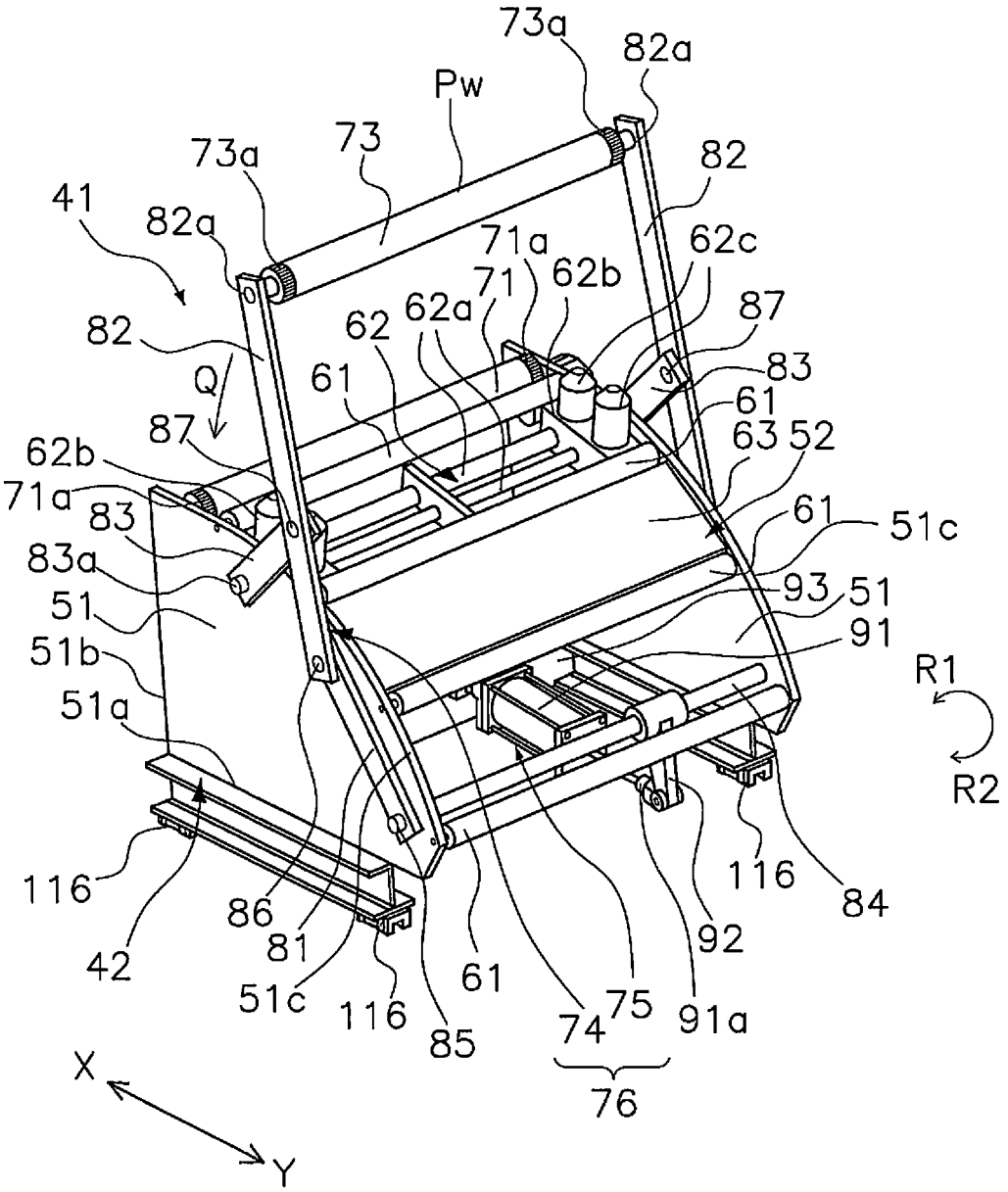
FIG. 4 is an oblique view of the configuration of the catenary component and the clamper of the coiled material passing device in the coil line system in FIG. 1.

FIG. 4 is an oblique view of the configuration of the clamper 41 and the catenary component 42. As shown in FIG. 4, the catenary component 42 has a pair of support plates 51 and a support 52 formed between the pair of support plates 51.

The support plates 51 are disposed across from each other, facing left and right in the X and Y directions of the coiled material 100. The support plates 51 are substantially fan shaped, with a central angle of about 90 degrees, one radius portion 51*a* is disposed horizontally, and the other radius portion 51*b* is disposed in the vertical direction. An arc portion 51*c* is formed on the uncoiler 3 side (the upstream direction Y side).

The support 52 is disposed between the pair of support plates 51 and curves along the arc portions 51*c*. The support 52 has a plurality of free rolls 61, a catenary side guide 62, and a guide plate 63. In FIG. 4, four free rolls 61 are rotatably supported between the support plates 51. The four free rolls 61 are spaced apart at a specific distance along the conveyance direction of the coiled material 100.

In FIG. 4, the catenary side guide 62 is disposed between the first and second free rolls 61 from the downstream direction X side. The catenary side guide 62 has two rod-like members 62*a* disposed between the support plates 51, and a pair of side guides 62*b* disposed opposite each other and facing left and right in the conveyance direction. The two rod-like members 62*a* are inserted into the side guides 62*b*, and the side guides 62*b* are able to move along the rod-like members 62*a* in a direction perpendicular to the conveyance direction. The side guides 62*b* have rolls 62*c* that can rotate around the vertical direction, and the rolls 62*c* hit the end of the coiled material 100 being used, restrict the movement of the coiled material 100 in the width direction, and guide it in the conveyance direction.

The guide plate 63 is disposed so as to fill in the space between the second and third free rolls 61 from the downstream direction X side.

1-4-2. Clamper 41

As shown in FIGS. 1 and 3, the clamper 41 has a lower pinch roll 71, a pinch roll drive motor 72, a threading roll 73, and a threading roll driver 76.

The lower pinch roll 71 and the threading roll 73 clamp the coiled material 100. The threading roll driver 76 moves the threading roll 73 between a standby position Pw (see FIG. 4) and a clamping position Ps (see FIG. 5) (discussed below). As shown in FIG. 1, the threading roll driver 76 has a link 74 that links the threading roll 73 and the catenary component 42, and a link driver 75 for driving the link 74.

Lower Pinch Roll 71

As shown in FIG. 4, the lower pinch roll 71 is rotatably disposed at the end on the downstream direction X side, between the pair of support plates 51. Specifically, the lower pinch roll 71 is disposed near the corner formed by the radius portion 51*b* and the arc portion 51*c*, more on the downstream direction X side than the support 52. The lower pinch roll 71 has gears 71*a* at both ends.

Pinch Roll Drive Motor 72

As shown in FIG. 3, the pinch roll drive motor 72 is fixed to the outside of one support plate 51 (the right side in the downstream direction X). Driving the pinch roll drive motor 72 rotates the lower pinch roll 71.

Threading Roll 73

Figure 5:
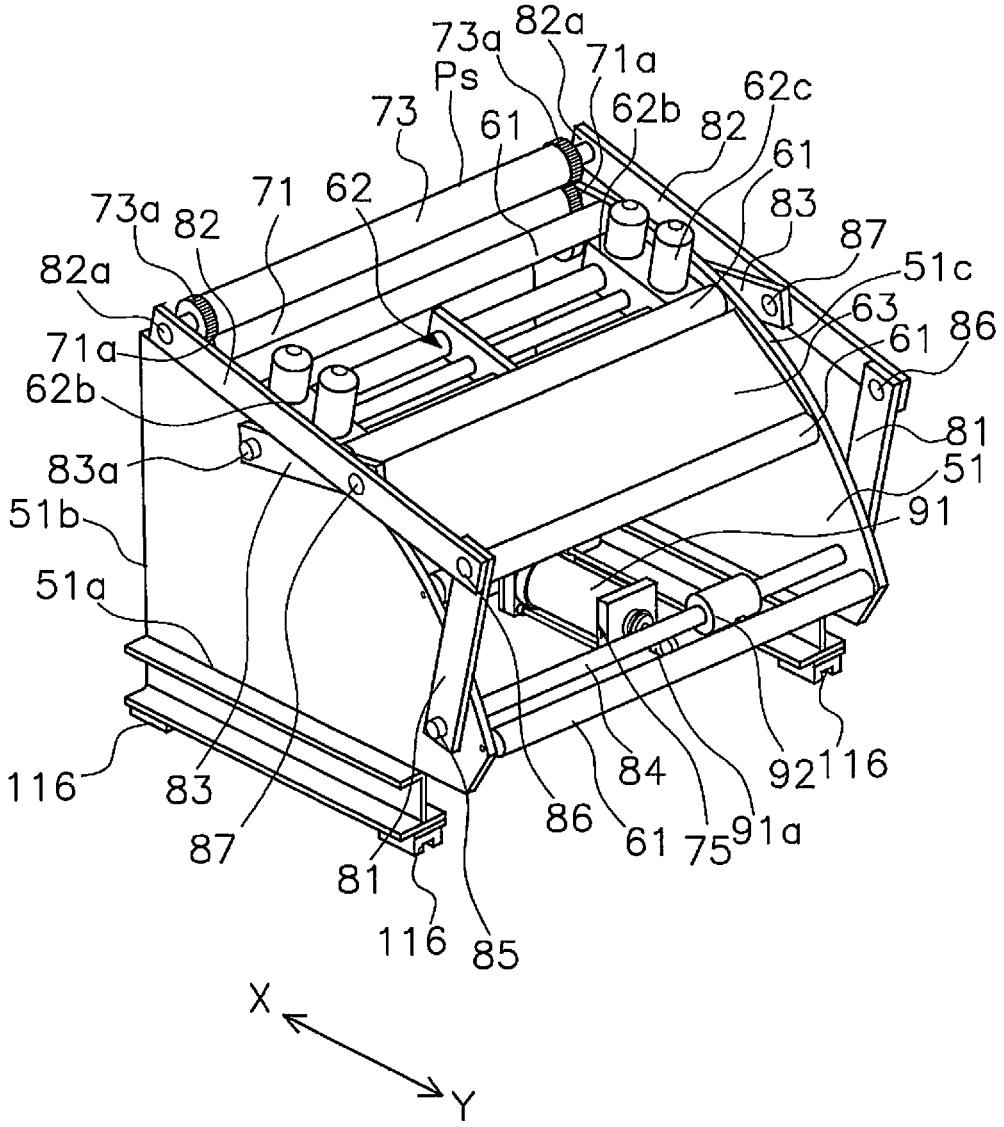
FIG. 5 is an oblique view of the configuration of the catenary component and the clamper in a state in which the clamper in FIG. 4 is closed.

As shown in FIG. 4, the threading roll 73 is rotatably attached to the link 74, and the link 74 is supported by the catenary component 42. The threading roll 73 has gears 73*a* at both ends. As shown in FIG. 5, the gears 73*a* of the threading roll 73 mesh with the gears 71*a* at both ends of the lower pinch roll 71 at the clamping position Ps.

Link 74

As shown in FIG. 4, the link 74 has two first link members 81, two second link members 82, two third link members 83, and a connecting member 84. The first link members 81, the second link members 82, and the third link members 83 are each in the form of a long, slender plate.

The first link members 81 are rotatably provided on the outside of the support plates 51. The first link members 81 are connected to each other at connecting parts 85 at one end thereof by the rod-shaped connecting member 84 that passes perpendicularly through the pair of support plates 51. The connecting member 84 is disposed at the end of the support plates 51 on the upstream direction Y side (near the edge of the arc portions 51*c*).

One end of a second link member 82 is disposed rotatably with the other end of a first link member 81 at a connecting part 86. The threading roll 73 is rotatably disposed at the ends 82*a* of the second link members 82 on the opposite side from the connecting parts 86.

The third link members 83 are rotatably supported at one end 83*a* thereof by the support plates 51. The ends 83*a* are attached on the upstream direction Y side of the lower pinch roll 71, on the outside of the support plates 51. The third link members 83 are rotatably linked at their other end to the second link members 82 at connecting parts 87. The connecting parts 87 are provided between the connecting parts 86 and the ends 82*a*.

Link Driver 75

As shown in FIG. 4, the link driver 75 has a threading roll drive cylinder 91 and a linking lever 92. The threading roll drive cylinder 91 is disposed below the support 52 on the downstream side X side of the connecting member 84. More precisely, the threading roll drive cylinder 91 is attached to a support member 93 fixed across a pair of support plates 51. A rod 91*a* of the threading roll drive cylinder 91 extends in the upstream direction Y.

The linking lever 92 is fixed to the connecting member 84, and its distal end is connected to the distal end of the rod 91*a* so as to be rotatable in the XY direction.

In the state shown in FIG. 4, the rod 91*a* extends in the upstream direction Y, and the connecting member 84 has rotated in the direction of the arrow R1. The first link members 81 have also been rotated in the direction of the arrow R1 by the rotation of the connecting member 84 in the direction of the arrow R1, and the second link members 82 have been rotated in the direction of the arrow R2 (the opposite side from the arrow R1), with the connecting parts 87 to the third link members 83 serving as a fulcrum. Consequently, the ends 82*a* of the second link members 82 are positioned above, and the threading roll 73 is also positioned above. This above position of the threading roll 73 is the standby position Pw.

On the other hand, when the rod 91*a* is contracted in the downstream direction X from the state shown in FIG. 4, the connecting member 84 rotates in the direction of the arrow R2. This rotation causes the first link members 81 also to rotate in the direction of the arrow R2, and the second link members 82 to rotate in the direction of the arrow R1 (the opposite side from the arrow R2), with the connecting parts 87 to the third link members 83 serving as a fulcrum. When the second link members 82 rotate, the third link members 83 also rotate in the direction of the arrow R2, so the connecting parts 87 also rotate in the direction of the arrow R2.

Consequently, the threading roll 73 moves downward toward the lower pinch roll 71 (see the arrow Q).

FIG. 5 is a diagram of a state in which the rod 91*a* has contracted in the downstream direction X. As shown in FIG. 5, the threading roll 73 is disposed in the clamping position Ps in which the threading roll 73 presses on the lower pinch roll 71, and the coiled material 100 can be clamped between the threading roll 73 and the lower pinch roll 71.

1-4-3. Driver 43

The driver 43 moves the catenary component 42 between the leveler feeder 2 and the uncoiler 3. As shown in FIG. 2, the driver 43 has a catenary drive motor 111, a catenary drive ball screw 112, an encoder 113, and catenary support guides 114.

As shown in FIG. 2, the catenary drive motor 111 is disposed below the housing 2*a* of the leveler feeder 2. The catenary drive ball screw 112 is linked to the catenary drive motor 111 and is disposed from the leveler feeder 2 to the uncoiler 3 along the XY direction. Also, a nut member 115 is fixed to the support member 93 of the above-mentioned catenary component 42, and the nut member 115 is threaded onto the catenary drive ball screw 112.

The encoder 113 is disposed at an end of the catenary drive ball screw 112 in the upstream direction Y. Rotation of the catenary drive ball screw 112 can be detected by the encoder 113, and the position of the catenary component 42 in the XY direction can also be detected. As shown in FIG. 1, the catenary support guides 114 are disposed parallel to the catenary drive ball screw 112 on the left and right sides of the catenary drive ball screw 112. As shown in FIG. 4, sliders 116 are provided at both ends along the conveyance direction of the radius portions 51*a* of the support plates 51. The sliders 116 are disposed on the catenary support guides 114 and can slide along the catenary support guides 114. The catenary support guides 114 and the sliders 116 are constituted by an LM guide (registered trademark), for example.

With the above configuration, when the catenary drive ball screw 112 is rotated by the rotation of the catenary drive motor 111, the catenary component 42 to which the nut member 115 is fixed moves along the catenary support guides 114 in the downstream direction X or the upstream direction Y.

1-4-4. Passing Controller 44

FIG. 6 is a block diagram showing the control configuration of the coil line system 1.

The passing controller 44 controls the pinch roll drive motor 72, the threading roll drive cylinder 91, the catenary drive motor 111, and the catenary side guide 62 on the basis of a command from the system controller 5. The passing controller 44 controls the catenary drive motor 111 on the basis of the value detected by the encoder 113 to control the position of the catenary component 42 in the XY direction. Also, the passing controller 44 controls the catenary side guide 62 to match the position of the opposing pair of side guides 62*b* to the width of the coiled material 100.

2. Operation

The operation of the coil line system 1 in an embodiment of the present invention will now be described, and an example of the coiled material passing method of the present invention will also be discussed at the same time.

2-1. Coiled Material Passing Operation

Figure 7:
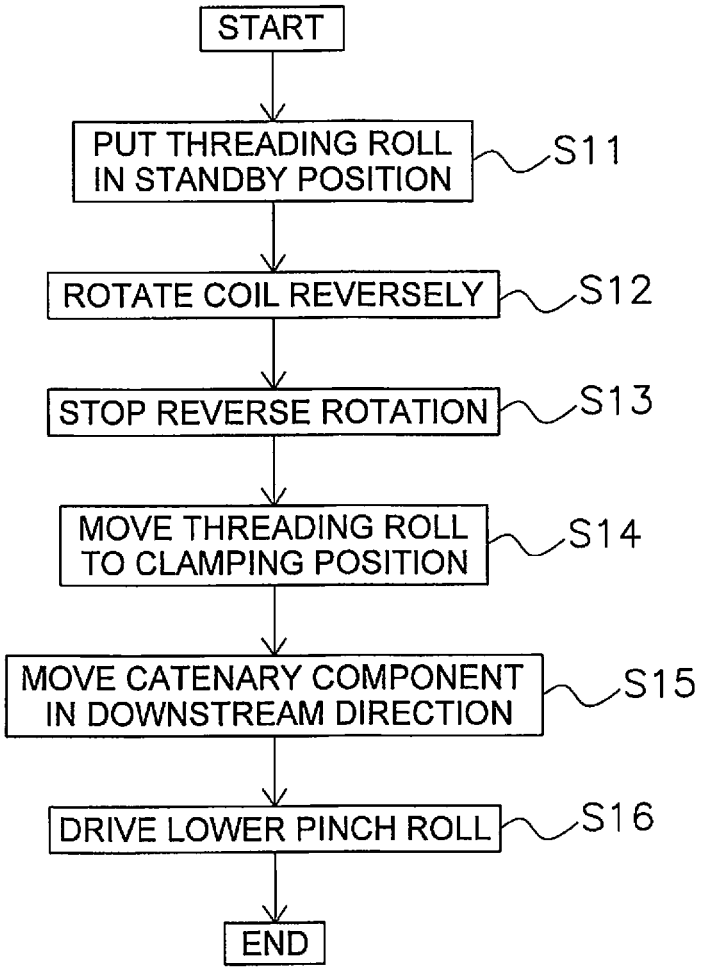
FIG. 7 is a flowchart of the operation of the coil line system in FIG. 1.

FIG. 7 is a flowchart of the operation of the coil line system in this embodiment.

First, in step S11, the threading roll 73 is in the standby position (see FIG. 1). More precisely, the passing controller 44 drives the catenary drive motor 111 and moves the catenary component 42 in the upstream direction Y until the catenary component 42 hits the outer periphery 10*e* of the coiled material 100 (see FIGS. 8A to 8D). Also, the rod 91*a* of the threading roll drive cylinder 91 is extended in the upstream direction Y, which causes the connecting member 84 to rotate in the direction of the arrow R1, and the first link members 81 also to rotate in the direction of the arrow R1. Consequently, the ends 82*a* of the second link members 82 move upward, and the threading roll 73 is disposed in the standby position Pw near the outer periphery of the coiled material 100.

Figure 8A:
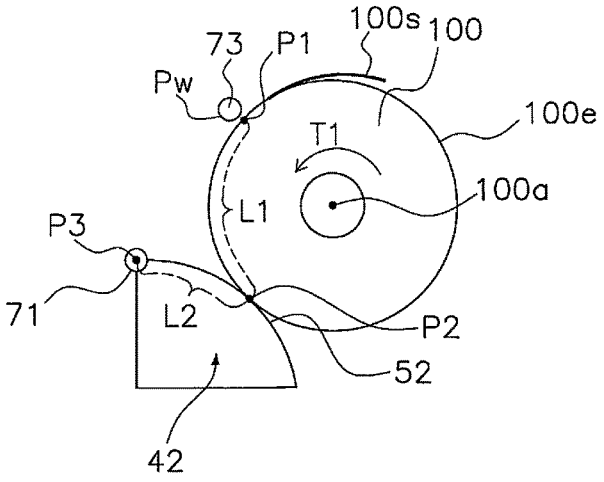
FIG. 8A is a diagram showing the positional relation between the coiled material passing device in FIG. 1 and a coiled material attached to an uncoiler.

FIG. 8A is a simplified diagram of the positional relation between the threading roll 73, the lower pinch roll 71, the catenary component 42, and the coiled material 100. As shown in FIG. 8A, in the standby position Pw, the threading roll 73 is disposed above the center 100*a* of the coiled material 100 and near the outer periphery 100*e* of the coiled material 100. If we let P1 be the position on the outer periphery 100*e* closest to the threading roll 73 (this can also be called the intersection between the outer periphery 100*e* and a straight line connecting the center of the threading roll 73 and the center 100*a*), P2 be the point of contact between the support 52 and the outer periphery 100*e* of the coiled material 100, and P3 be the center position of the lower pinch roll 71, then the length L1 along the outer periphery 100*e* from the position P1 to the position P2 is set to be longer than the length L2 along the curve of the support 52 from the position P2 to the position P3.

Next, in step S12, the uncoiler controller 34 controls the drive mechanism 33 to rotate the coiled material 100 reversely (see the arrow T1 in FIG. 8A) on the basis of a command from the system controller 5. Here, forward rotation is the direction in which the coiled material 100 is played out, and is the opposite direction from that of the arrow T1.

When the coiled material 100 is rotated reversely and the starting end 100*s* of the coiled material 100 goes past the threading roll 73, in step S13 the uncoiler controller 34 controls the drive mechanism 33 to stop the rotation of the coiled material 100. An encoder or the like provided in the drive mechanism 33 detects that the starting end 100*s* has passed the threading roll 73.

Figure 8B:
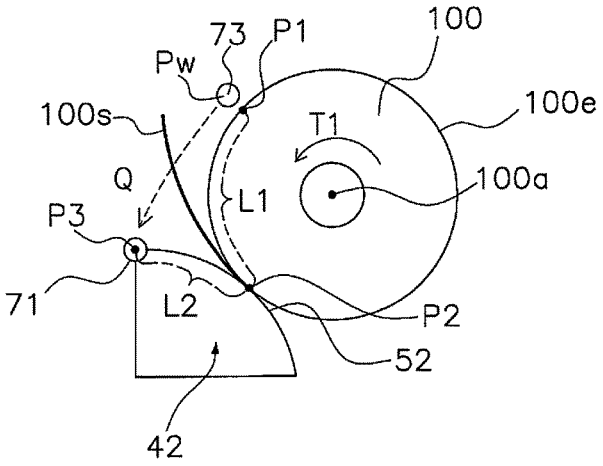
FIG. 8B is a diagram of a state in which the uncoiler in FIG. 8A is rotated in reverse so that the starting end of the coil has passed a threading roll.
Figure 9:
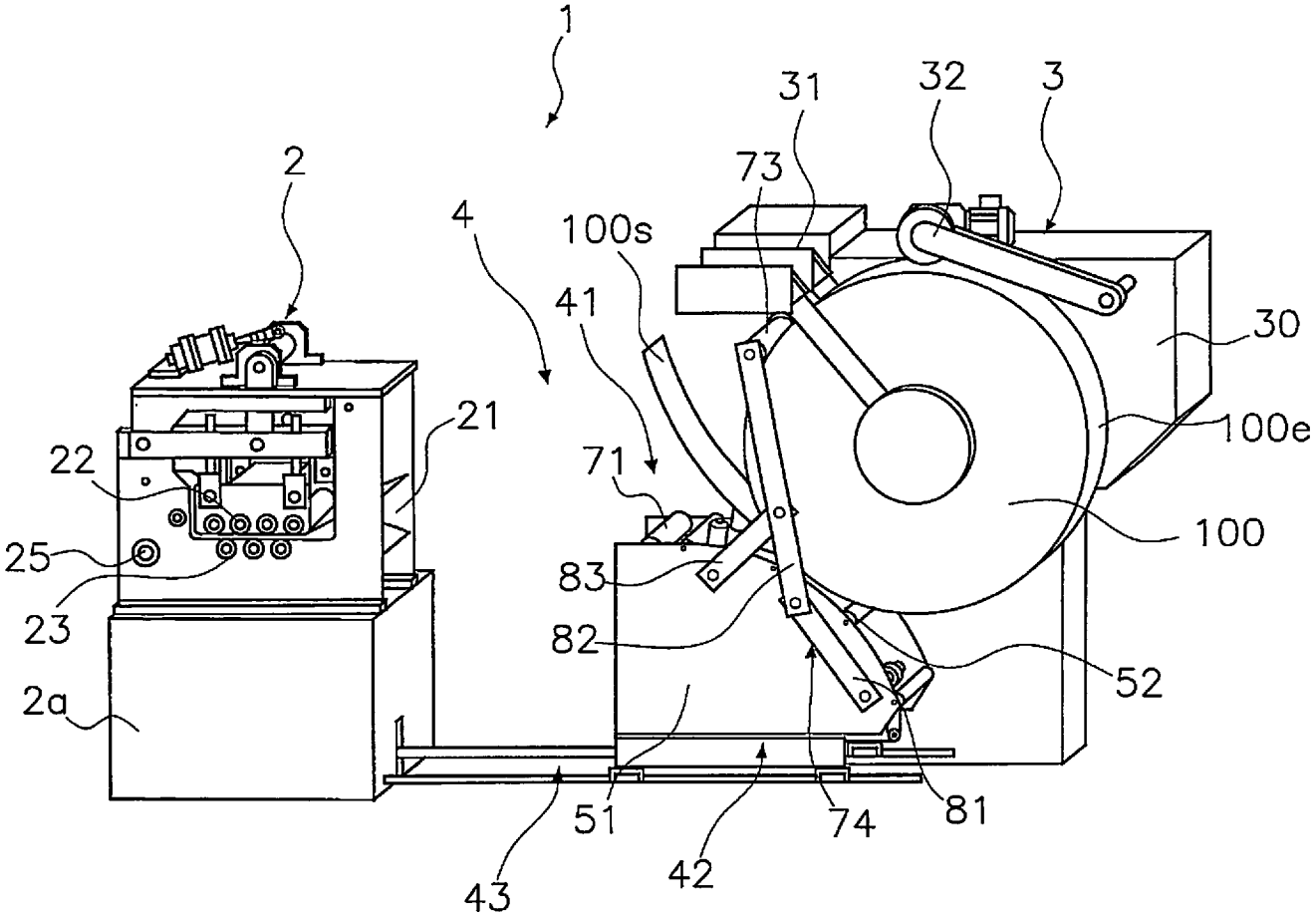
FIG. 9 is an oblique view of the coil line system showing the state in FIG. 8B.

When the starting end 100*s* of the coiled material 100 passes the threading roll 73, the starting end 100*s* is separated from the outer periphery 100*e* of the coiled material 100 under its own weight, by its rigidity, etc., as shown in FIG. 8B. FIG. 9 shows the coil line system 1 in a state in which the starting end 100*s* of the coiled material 100 has thus passed the threading roll 73.

The starting end 100*s* of the coiled material 100 protrudes more on the downstream direction X side than the threading roll 73, as shown in FIGS. 8B and 9.

Next, in step S14, the passing controller 44 lowers the threading roll 73 from the standby position Pw to the clamping position Ps at which the threading roll 73 presses on the lower pinch roll 71. More precisely, the passing controller 44 drives the threading roll drive cylinder 91 to contract the rod 91*a* in the downstream direction X. Consequently, as shown in FIGS. 4 and 5, the connecting member 84 rotates in the R2 direction, the first link members 81 also rotate in the R2 direction, the ends 82*a* of the second link members 82 move in the arrow Q direction, with the connecting parts 87 as a fulcrum, and the threading roll 73 also descends in the arrow Q direction.

Figure 8C:
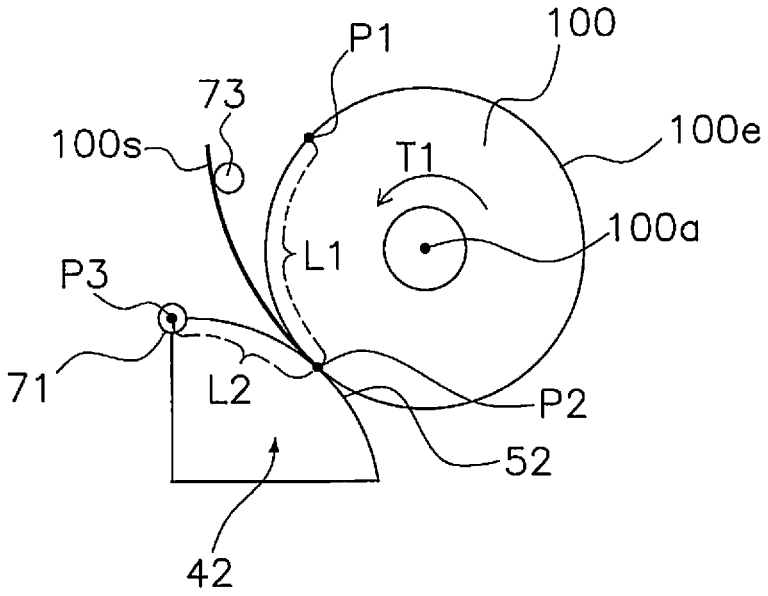
FIG. 8C is a diagram showing a state in which the threading roll in FIG. 8B is moved downward so that it hits the starting end of the coiled material.

That is, as shown in FIG. 8B, the threading roll 73 moves downwards while scribing a slight arc due to the pivoting of the link 74, and hits the inner surface of the starting end 100*s* of the coiled material 100 as shown in FIG. 8C. Then, when the threading roll 73 moves downward, the starting end 100*s* of the coiled material 100 is held down from above by the threading roll 73 and also moves downward. When the threading roll 73 moves downward so as to scribe a slight arc, the threading roll 73 can be lowered to a position close to the outer periphery 100*e* of the coiled material 100 without interfering with the outer periphery 100*e* of the coiled material 100. Therefore, the clamping position Ps of the starting end 100*s* of the coiled material 100 can be near the coiled material 100.

Figure 8D:
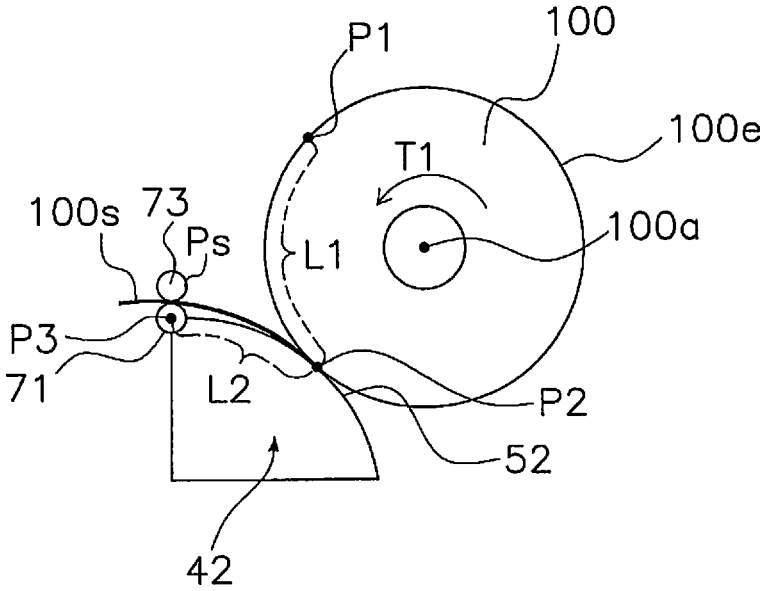
FIG. 8D is a diagram showing a state in which the threading roll in FIG. 8C is moved further downward to clamp the starting end of the coiled material between the threading roll and a lower pinch roll.
Figure 10:
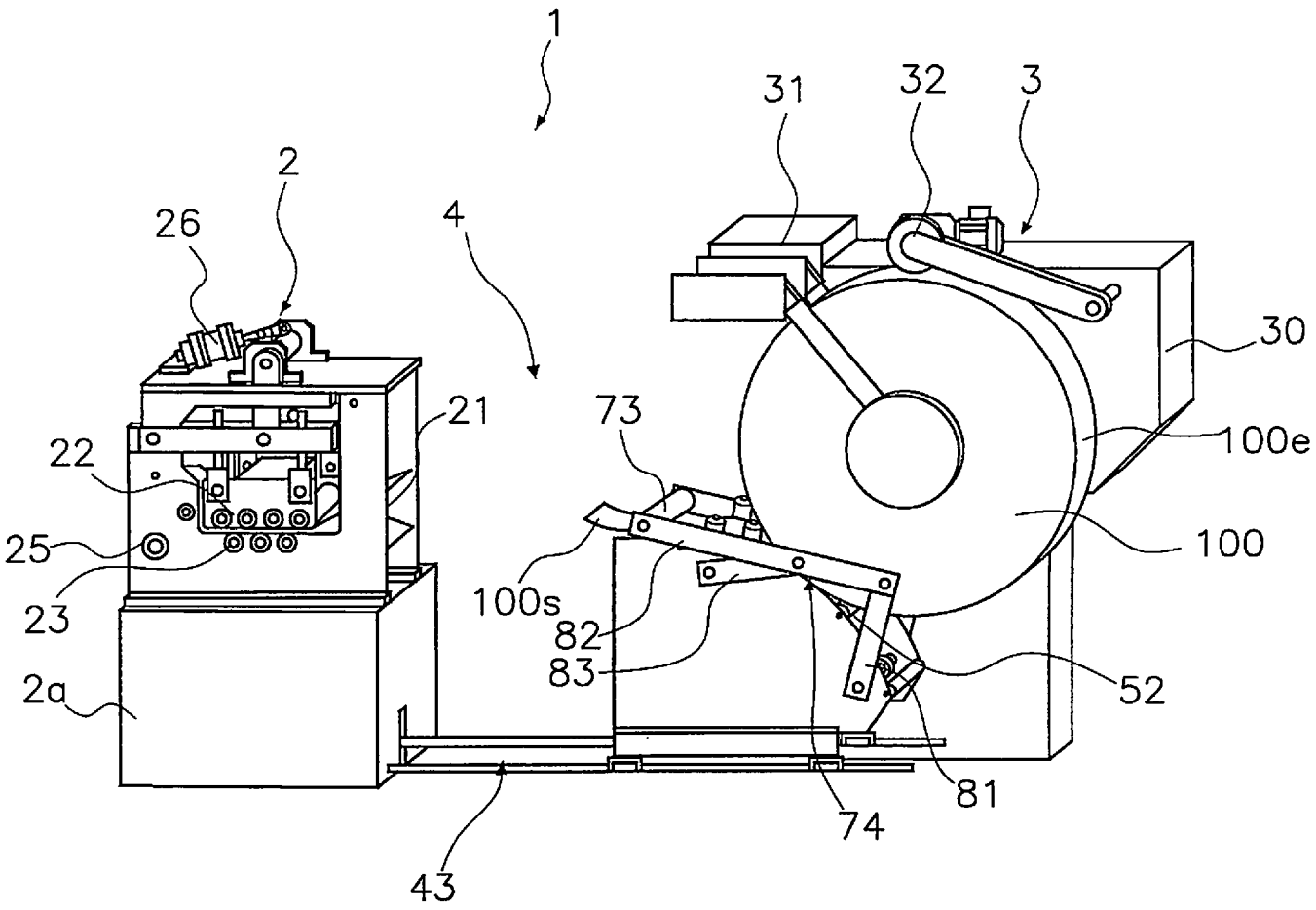
FIG. 10 is an oblique view of the coil line system showing the state in FIG. 8D.

When the threading roll 73 moves to the clamping position Ps where the threading roll 73 presses on the lower pinch roll 71, as shown in FIG. 8D, the starting end 100*s* of the coiled material 100 is clamped between the lower pinch roll 71 and the threading roll 73. FIG. 10 shows the coil line system 1 in a state in which the starting end 100*s* of the coiled material 100 is thus clamped between the lower pinch roll 71 and the threading roll 73. Before the clamping by the lower pinch roll 71 and the threading roll 73 is completed, the passing controller 44 adjusts the catenary side guide 62 to match the width of the coiled material 100.

Figure 11:
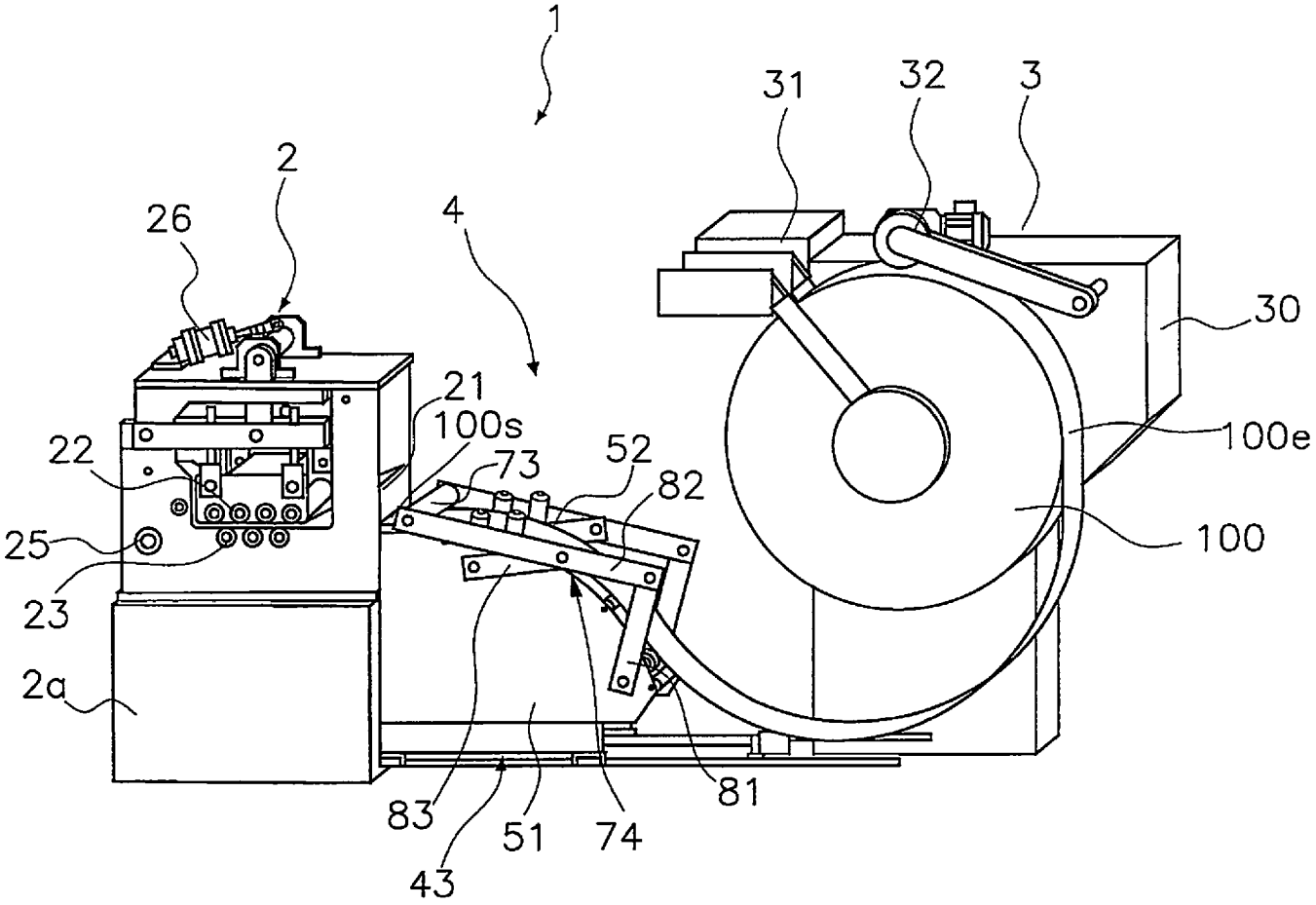
FIG. 11 is a diagram showing a state in which the catenary component is moved from the state in FIG. 10 to the leveler feeder.

Next, in step S15, the passing controller 44 drives the catenary drive motor 111 to move the catenary component 42 to the leveler feeder 2 in a state in which the starting end 100*s* is clamped. Since the lower pinch roll 71 and the threading roll 73 mesh with each other at the gears 71*a* and 73*a* at both ends of the rolls, the clamped state of the starting end 100*s* of the coiled material 100 is maintained even during movement. The passing controller 44 stops the catenary component 42 in front of the leveler feeder 2 on the basis of the detected value from the encoder 113. FIG. 11 shows the coil line system 1 in a state in which the catenary component 42 has been moved to the leveler feeder 2 side. Along with the movement of the catenary component 42, the uncoiler controller 34 controls the drive mechanism 33 to rotate the coiled material 100 forward to play out the coiled material 100.

Next, in step S16, the passing controller 44 drives the pinch roll drive motor 72 to rotationally drive the lower pinch roll 71 and the threading roll 73.

The rotation of the lower pinch roll 71 and the threading roll 73 causes the starting end 100*s* of the coiled material 100 to be supplied to the receiver port 21 formed by the upper guide plate 21*a* and the lower guide plate 21*b*.

The coiled material 100 can be passed to the leveler feeder 2 by the above operation.

2-2 Winding of Coiled Material

Next, the operation for winding the coiled material will be described.

When the pressing operation ends, if there is still some coiled material 100, this coiled material 100 is wound up and stored.

After the pressing operation ends and the coiled material 100 has been cut, the uncoiler controller 34 controls the drive mechanism 33 to rotate the coiled material 100 backward to perform the winding operation of the coiled material 100. Then, any slack in the coiled material 100 produced in the pressing operation is wound up to put the coiled material 100 in a taut state.

From this taut state, the uncoiler controller 34 rotates the coiled material 100 backward to wind up the coiled material 100, and along with this winding, the passing controller 44 moves the catenary component 42 toward the uncoiler 3 in a state in which the coiled material 100 is clamped by the clamper 41.

By thus moving the catenary component 42 to near the coiled material 100, it is possible to wind up the coiled material 100 into a tight coil, with as little slack as possible. That is, since the back tension produced by the threading roll 73 and the lower pinch roll 71 can be loaded near the outer periphery 100*e* of the coiled material 100, the coiled material 100 can be wound without loosening.

Also, the catenary component 42 moves to a position where the threading roll 73 hits the coiled material 100, the support 52 (the free rolls 61, etc.) of the catenary component 42 is pressed against the coiled material 100, and the end of the unwound coiled material 100 is guided by the catenary side guide 62 to near the outer periphery 100*e*, so offset in the width direction of the coiled material 100 can also be reduced.

3. Features (3-1)

The coiled material passing device 4 in this embodiment is a coiled material passing device for passing a coiled material 100 played out by an uncoiler 3 to a leveler feeder 2 that corrects any winding curl in the coiled material, and comprises the clamper 41, the catenary component 42 (an example of a moving body), and the driver 43 (an example of a first driver). The clamper 41 clamps the starting end 100*s* of the coiled material 100 played out from the uncoiler 3. The catenary component 42 supports the clamper 41 and is able to move between the uncoiler 3 and the leveler feeder 2. The driver 43 moves the catenary component 42.

Therefore, the starting end 100*s* of the coiled material 100 can be passed through the leveler feeder 2 by moving the catenary component 42 to the leveler feeder 2 in a state in which the starting end 100*s* of the coiled material 100 is clamped by the clamper 41.

That is, since the clamper 41 can be moved, the starting end 100*s* of the coiled material 100 can be clamped near the uncoiler 3, for example. Therefore, there are substantially no members that will interfere with the starting end 100*s* of the coiled material 100, which reduces the possibility that the starting end 100*s* of the coiled material 100 will catch on the device components.

Also, after the starting end 100*s* of the coiled material 100 has been clamped near the coiled material 100, the clamper 41 moves in this clamped state, and the starting end 100*s* of the coiled material 100 is moved to the leveler feeder 2, so the operator does not have to make fine adjustments to the amount of playout of the coiled material as in the past, and the coiled material 100 can be easily fed into the leveler feeder 2.

As described above, the starting end 100*s* of the coiled material 100 played out from the uncoiler 3 can be easily and stably passed through the leveler feeder 2.

(3-2)

With the coiled material passing device 4 in this embodiment, the clamper 41 has the threading roll 73 (an example of a first roll), the lower pinch roll 71 (an example of a second roll), and the threading roll driver 76 (an example of a second driver). The threading roll 73 is able to move between the clamping position Ps at which the starting end 100*s* of the coiled material 100 played out from the uncoiler 3 is clamped, and the standby position Pw above the center 100*a* of the coiling material 100 in a state of being attached to the uncoiler. The lower pinch roll 71 is disposed below the threading roll 73, and, along with the threading roll 73 disposed in the clamping position Ps, clamps the coiled material 100 played out from the uncoiler 3. The threading roll driver 76 moves the threading roll 73 between the clamping position Ps and the standby position Pw.

As a result, the threading roll 73 can be moved downward and the starting end 100*s* of the coiled material 100 can be clamped between the threading roll 73 and the lower pinch roll 71. Also, since the threading roll 73 is disposed above the center 100*a* of the coiled material 100, the starting end 100*s* of the coiled material 100 which has passed the threading roll 73 by reverse rotation of the coiled material 100 is positioned lower than the threading roll 73. Therefore, the starting end 100*s* of the coiled material 100 can be clamped between the threading roll 73 and the lower pinch roll 71 by moving the threading roll 73 downward.

Also, since the starting end 100*s* of the coiled material 100 is positioned lower than the threading roll 73 merely by rotating the coiled material 100 reversely, the coiled material 100 can be stably clamped, without having to rotate and feed the coiled material 100 forward before the starting end 100*s* of the coiled material 100 has been clamped.

(3-3)

With the coiled material passing device 4 in this embodiment, in a state in which the catenary component 42 has been moved to the uncoiler 3 side by the driver 43, the standby position Pw is a position near the outer periphery 100*e* of the coiled material 100 in a state of being attached to the uncoiler 3.

Since the threading roll 73 is thus put on standby near the outer periphery 100*e* of the coiled material 100, even if the coiled material 100 is very stiff, the starting end 100*s* of the coiled material 100 that has passed the threading roll 73 is positioned below the threading roll 73 by reversely rotating the coiled material 100 and protrudes on the downstream direction X side. Therefore, the starting end 100*s* of the coiled material 100 can be clamped between the threading roll 73 and the lower pinch roll 71 by moving the threading roll 73 downward.

(3-4)

With the coiled material passing device 4 in this embodiment, the catenary component 42 has the support 52. The support 52 is disposed more on the uncoiler 3 side than the lower pinch roll 71, and supports the played-out coiled material 100 from below. The support 52 hits the outer periphery 100*e* of the coiled material 100 attached to the uncoiler 3 as a result of the movement of the catenary component 42 to the uncoiler 3 side by the driver 43.

Thus, the support 52 hits the outer periphery 100*e* of the coiled material 100 and supports the coiled material 100 from below, allowing the coiled material 100 unwound from a coiled state to be stably supplied between the threading roll 73 and the lower pinch roll 71.

This eliminates the need for a loop guide below the coiled material.

(3-5)

With the coiled material passing device 4 in this embodiment, the support 52 is disposed in a curved shape. The length L2 along the curve from the contact position P2 between the support 52 and the coiled material 100 attached to the uncoiler 3, to the lower pinch roll 71 is shorter than the length L1 along the outer periphery 100*e* of the coiled material 100 from the outer peripheral position P1 closest to the standby position Pw of the coiled material 100 attached to the uncoiler 3, to the contact position P2.

As a result, the length of the portion of the coiled material 100 separated from its coiled state, which has passed the threading roll 73 as a result of the reverse rotation of the coiled material 100, is approximately L1. Since this length L1 is longer than the length L2 from the contact position P2 to the position of the lower pinch roll 71, the threading roll 73 is moved downward and the coiled material 100 can be clamped between the threading roll 73 and the lower pinch roll 71.

(3-6)

The coiled material passing method in this embodiment is a coiled material passing method in which the coiled material 100 played out by the uncoiler 3 is passed through a leveler feeder 2 that corrects any winding curl in the coiled material 100, comprising steps S12 and S13 (examples of a reverse rotation step), step S14 (an example of a clamping step), and step S15 (an example of a movement step). Steps S12 and S13 (examples of reverse rotation step) involve rotating the uncoiler 3 backward until the starting end 100*s* of the coiled material 100 passes the threading roll 73 disposed near the outer periphery 100*e* and above the center 100*a* of the coiled material 100 attached to the uncoiler 3. Step S14 (an example of a clamping step) involves moving the threading roll 73 toward the lower pinch roll 71 disposed below the threading roll 73, so that the threading roll 73 hits the starting end 100*s* of the coiled material 100 from above, and the starting end 100*s* of the coiled material 100 is clamped by the threading roll 73 and the lower pinch roll 71. Step S15 (an example of a movement step) involves moving the threading roll 73 and the lower pinch roll 71 to the leveler feeder 2 in a state in which the starting end 100*s* of the coiled material 100 is clamped.

Consequently, the starting end 100*s* of the coiled material 100 can be passed through the leveler feeder 2 by moving the catenary component 42 to the leveler feeder 2 in a state in which the starting end 100*s* of the coiled material 100 is clamped by the clamper 41.

Specifically, since the clamper 41 can be moved, the starting end 100*s* of the coiled material 100 can be clamped near the uncoiler 3, for example. Therefore, the risk that the starting end 100*s* will catch on any of the device components when the coiled material 100 is played out can be reduced.

Also, after the starting end 100*s* of the coiled material 100 has been clamped near the coiled material 100, the clamper 41 moves in this clamped state, and the starting end 100*s* of the coiled material 100 is moved to the leveler feeder 2, so the operator does not have to make fine adjustments to the amount of playout of the coiled material as in the past, and the coiled material 100 can be easily fed into the leveler feeder 2.

As described above, the starting end 100*s* of the coiled material 100 played out from the uncoiler 3 can be easily and stably passed through the leveler feeder 2.

4. Other Embodiments

An embodiment of the present invention was described above, but the present invention is not limited to or by the above embodiment, and various modifications are possible without departing from the gist of the invention.

(A)

In the above embodiment, the threading roll 73 was moved from the standby position Pw to the clamping position Ps by the link 74 and the link driver 75, but this configuration is not the only option. For example, the threading roll 73 may be moved by a cylinder. In other words, any configuration may be used as long as the threading roll 73 can be moved.

(B)

In the above embodiment, the driver 43 for moving the catenary component 42 had the catenary drive motor 111, the catenary drive ball screw 112, and so forth, but this configuration is not the only option. For example, the catenary component 42 may be moved by a rack and pinion or the like. In other words, any configuration may be used as long as the catenary component 42 can be moved.

(C)

In the above embodiment, it was stated that when the catenary component 42 was moved to the uncoiler 3 side, the support 52 of the catenary component 42 hit the outer periphery 100*e* of the coiled material 100, but the support 52 of the catenary component 42 may be disposed near the outer periphery 100*e* of the coiled material 100. In this case, the position P2 shown in FIG. 8A may be the position on the outer periphery 100*e* that is closest to the support 52.

(D)

In the above embodiment, the system controller 5, the leveler controller 20, the uncoiler controller 34, and the passing controller 44 were described separately, but the system controller 5, the leveler controller 20, the uncoiler controller 34, and the passing controller 44 may all be combined into a single control device.

(E)

Steps S11 to S16 in the flowchart in FIG. 7 may be performed automatically, or may be performed by button operations on a control panel while the operator visually confirms each operation.

INDUSTRIAL APPLICABILITY

The coiled material passing device and the coiled material passing method of the present invention allow material to be simply and stably passed, and are useful in a coil line system or the like for supplying a coiled material to a pressing machine.

The invention claimed is:

1. A coiled material passing device adapted to support a coiled material played out from an uncoiler at a position lower than a center of the coiled material in a state of being attached to the uncoiler and pass the played out coiled material to a leveler feeder configured to correct any winding curl of the coiled material, the coiled material passing device comprising:

a clamper configured to clamp a starting end of the coiled material played out from the uncoiler, the clamper including a first roll movable between a standby position and a clamping position, the standby position being above the center of the coiled material in the state of being attached to the uncoiler and the clamping position being a position in which the starting end of the coiled material played out from the uncoiler is clamped, a second roll disposed below the first roll and arranged such that the coiled material played out from the uncoiler is clamped between the first roll and the second roll when the first roll is in the clamping position, and a second driver configured to move the first roll between the clamping position and the standby position;

a moving body that supports the clamper, the moving body being movable between the uncoiler and the leveler feeder, the moving body including a pair of support plates spaced apart from each other in a widthwise direction of the coiled material, the widthwise direction being perpendicular to a movement direction in which the moving body moves between the uncoiler and the lever feeder, each of the support plates having a fan-like shape including an arc portion that arcuately spans between an upper side and an upstream side of the support plate; and a first driver configured to move the moving body between the uncoiler and the lever feeder, the moving body including a support disposed closer to the uncoiler than the second roll is, the support having a curved shape that protrudes convexly toward the uncoiler, the curved shape of the support being configured to curve along the arc portions of the support plates, the second roll and the support are attached to the support plates so as to span between the support plates in the widthwise direction, the second roll and the support being disposed at least partially between the support plates in a side view along the widthwise direction, and the support being configured and arranged such that when the moving body is moved toward the uncoiler by the first driver, the support hits against an outer periphery of the coiled material in the state of being attached to the uncoiler and supports the played out coil material from below.

2. The coiled material passing device according to claim 1, wherein in the standby position, the first roll is above the moving body and in a vicinity of the outer periphery of the coiled material in a state in which the moving body has been moved to a side of the uncoiler by the first driver.

3. The coiled material passing device according to claim 2, wherein a length along a curve of the curved shape from the second roll to a contact position where the support hits the coiled material in the state of being attached to the uncoiler is shorter than a length around the outer periphery of the coiled material from the contact position to an outer peripheral position closest to the standby position of the coiled material in the state of being attached to the uncoiler.

4. A coiled material passing method adapted to pass a coiled material played out by an uncoiler through a leveler feeder configured to correct any winding curl of the coiled material, the coiled material passing method comprising:

arranging the coiled material on the uncoiler such that, when the coiled material is rotated in a forward direction, the coiled material will play out toward the leveler feeder from a position lower than a center of the coiled material in a state of being attached to the uncoiler;

moving a moving body toward the uncoiler until a support provided on the moving body contacts an outer periphery of the coiled material in the state of being attached to the uncoiler, the moving body supporting a first roll and a second roll, the first roll being movable between a standby position and a clamping position, the standby position being closer to the uncoiler than the clamping position and higher than the center of the coiled material in the state of being attached to the uncoiler, the clamping position being a position lower than the standby position and above the second roll, and the support being disposed closer to the uncoiler than the second roll is and having a curved shape that protrudes convexly toward the uncoiler;

rotating the uncoiler in a reverse direction opposite the forward direction while the first roll is in the standby position and the support contacts the outer periphery until a starting end of the coiled material separates and passes the first roll;

supporting the played out coiled material from below with the support;

clamping the starting end by moving the first roll to the clamping position while the second roll remains stationary with respect to the moving body so that the first roll hits the starting end of the coiled material from above and the starting end of the coiled material is clamped between the first roll and the second roll; and moving the first roll and the second roll to the leveler feeder in a state in which the starting end of the coiled material is clamped.

5. A coiled material passing device adapted to pass a coiled material in a transport direction from an uncoiler to a leveler feeder that is configured to correct any winding curl of the coiled material, the coiled material passing device comprising:

a moving body configured to be movable back and forth along the transport direction between the uncoiler on an upstream side and the leveler feeder on a downstream side, a clamper that is supported on the moving body and configured to clamp a starting end of the coiled material played out from the uncoiler, the clamper including a first roll pivotally movable with respect to the moving body between a clamping position and a standby position by a link attached to the moving body, the standby position being higher and farther toward the upstream side than the clamping position, a second roll rotatably attached to the moving body and disposed below the first roll in such a position that the first roll presses on the second roll when the first roll is in the clamping position, the first roll and the second roll extending in a widthwise direction of the coil material, the widthwise direction being perpendicular to the transport direction; and a first driver configured to move the moving body between the uncoiler and the leveler feeder, the moving body including a support disposed on an upstream side of the second roll, the support having a curved shape extending away from the second roll toward the upstream side and downward such that at least a portion of the support is disposed lower than the second roll, the support including at least two free rolls and a catenary side guide disposed between two of the at least two free rolls, each of the at least two free rolls extending in the widthwise direction and the catenary side guide including two pairs of side rolls spaced apart from each other in the widthwise direction, the side rolls being arranged to rotate about axes oriented in a vertical direction that is perpendicular to the widthwise direction and the transport direction.

6. The coiled material passing device according to claim 5, wherein the moving body includes a pair of support plates spaced apart from each other in the widthwise direction, the second roll and the support are attached to the support plates so as to span between the support plates in the widthwise direction, each of the support plates has a fan-like shape including an arc portion that forms an upper side and an upstream side of the support plate, and the curved shape of the support is configured to curve along the arc portions of the support plates.

7. The coiled material passing device according to claim 6, wherein the second roll protrudes at least partially above an uppermost edge of each of the support plates.

8. The coiled material passing device according to claim 5, wherein the support includes at least two free rolls extending in the widthwise direction.

9. The coiled material passing device according to claim 5, wherein the support includes a guide plate extending in the widthwise direction.

10. The coiled material passing device according to claim 5, wherein the support includes at least two free rolls and a guide plate disposed between two of the at least two free rolls, each of the free rolls and the guide plate extending in the widthwise direction.

11. The coiled material passing device according to claim 5, the link includes a pair of first link members, a pair of second link members, and a pair of third link members, each of the pairs being arranged on opposite sides of the moving body in the widthwise direction, each of the first and third link members being pivotally coupled to the moving body and each of the second link members being pivotally coupled to a corresponding one of the first link members and a corresponding one of the third link members.

12. The coiled material passing device according to claim 1, wherein the second roll protrudes at least partially above an uppermost edge of each of the support plates.

13. The coiled material passing device according to claim 1, wherein the support includes at least two free rolls extending in the widthwise direction.

14. The coiled material passing device according to claim 1, wherein the support includes a guide plate extending in the widthwise direction.

15. The coiled material passing device according to claim 1, wherein the support includes at least two free rolls and a guide plate disposed between two of the at least two free rolls, each of the at least two free rolls and the guide plate extending in the widthwise direction.

16. The coiled material passing device according to claim 1, wherein the support includes at least two free rolls and a catenary side guide disposed between two of the at least two free rolls, each of the free rolls extending in the widthwise direction and the catenary side guide including two pairs of side rolls spaced apart from each other in the widthwise direction, each of the side rolls being arranged to rotate about an axis oriented in a vertical direction that is perpendicular to the widthwise direction and the movement direction.

* * * * *